US010137458B2

(12) United States Patent
Baker

(10) Patent No.: US 10,137,458 B2
(45) Date of Patent: Nov. 27, 2018

(54) APPARATUS AND METHOD FOR ENTRAPPING MAGNETIC MATERIAL

(71) Applicant: ACTIVE MAGNETICS RESEARCH PTY LTD, Unanderra, NSW (AU)

(72) Inventor: William John Baker, Unanderra (AU)

(73) Assignee: Active Magnetics Research Pty Ltd, Unanderra, NSW (AU)

( * ) Notice: Subject to any disclaimer, the term of this patent is extended or adjusted under 35 U.S.C. 154(b) by 0 days.

(21) Appl. No.: 14/917,858

(22) PCT Filed: Sep. 10, 2014

(86) PCT No.: PCT/AU2014/050221
§ 371 (c)(1),
(2) Date: Mar. 9, 2016

(87) PCT Pub. No.: WO2015/035467
PCT Pub. Date: Mar. 19, 2015

(65) Prior Publication Data

US 2016/0221000 A1 Aug. 4, 2016

(30) Foreign Application Priority Data

Sep. 11, 2013 (AU) ..... 2013903478
Nov. 6, 2013 (AU) ..... 2013904285

(51) Int. Cl.
*B03C 1/033* (2006.01)
*B03C 1/22* (2006.01)
*B03C 1/02* (2006.01)

(52) U.S. Cl.
CPC ..... *B03C 1/0332* (2013.01); *B03C 1/02* (2013.01); *B03C 1/22* (2013.01); *B03C 2201/20* (2013.01)

(58) Field of Classification Search
CPC .... B03C 1/04; B03C 1/10; B03C 1/14; B03C 1/22; B03C 1/26; B03C 1/02; B03C 1/0332; B03C 2201/20; B07C 5/344; B03B 13/04
USPC .... 209/213, 214, 223.1, 225–228, 231, 232, 209/636
See application file for complete search history.

(56) References Cited

U.S. PATENT DOCUMENTS 2,183,971 A * 12/1939 Miller ..... B03B 5/26 209/12.1
2,410,601 A 11/1946 Crockett
2,792,115 A 5/1957 Medearis
5,927,508 A * 7/1999 Plath ..... B03C 1/08 209/215
6,253,924 B1 7/2001 Bleifuss et al.
2011/0127222 A1 6/2011 Chang-Yen et al.
2012/0301883 A1 11/2012 Pagano et al.

FOREIGN PATENT DOCUMENTS

GB 1183846 3/1970
JP H08174373 7/1996

* cited by examiner

*Primary Examiner* — Joseph C Rodriguez
*Assistant Examiner* — Kalyanavenkateshware Kumar
(74) *Attorney, Agent, or Firm* — Welsh Flaxman & Gitler LLC

(57) ABSTRACT

An apparatus for entrapping magnetic material comprising a magnetic sub-assembly and a retention trap removably attached thereto. The retention trap having an entrapment surface such that magnetic material drawn into the trap as a result of the magnetic influence of the magnetic sub-assembly, is magnetically held and mechanically trapped within said entrapment surface.

13 Claims, 10 Drawing Sheets

APPARATUS AND METHOD FOR ENTRAPPING MAGNETIC MATERIAL

TECHNICAL FIELD

The present invention relates to an apparatus for entrapping magnetic material. In particular, the present invention relates to an apparatus for entrapping magnetic pieces or magnetic contamination using magnetic influence in combination with mechanical entrapment to prevent downstream damage to manufacturing or processing equipment and/or from becoming a cause of product contamination.

BACKGROUND

In prior art, flat magnets are used in a wide variety of applications as floor and bench mats for workshops to catch highly magnetic dropped screws and nuts etc; for hanging tools on a wall; for attaching signs to a flat magnetic surface; for therapeutic purposes; as magnetic chute bottoms, as plate or suspension magnets at discharge of conveyors, suspended above conveyed materials and under or at the discharge of vibrating conveyors or feeders. Flat plate and suspension magnets are frequently positioned above moving material and have as simple magnet circuit with a comparatively wide space (air gap) between unlike poles for cost reduction reasons and to obtain depth of magnetic field. Consequently, a great proportion of the available magnetic energy from the magnet components is used to draw magnetic contamination through the material depth, in some situations also through a clearance gap and onto the magnet surface.

In the prior art, "depth of pull" is a prime consideration, and to achieve this, magnets are often extremely heavy and have deep fields at the expense of shallow fields of high flux density.

One or more retention steps, or a recessed air gap machined in the plate magnet surface is sometimes employed to improve retention of fine particles or spherical iron pieces. These are however, necessarily wide apart, few in number, form part of the magnet surface and (not being detachable) are more difficult to clean.

Non-magnetic covers or cover plates are sometimes employed on the working face of magnetic devices or flat face magnets and suspension magnets of prior art for the sole purpose of making such magnets easier to clean. Such covers do not increase the retention ability of the magnet. Because such quick cleaning covers increase the distance from an already weak magnetic working face, the ability of the magnet to retain weakly magnetic fines and fragments against opposing forces is thereby even further reduced.

Some prior art magnets used in industry have a strong magnetic influence, and in some instances there is a disadvantage with occupational health and safety issues with the manufacture and assembly of magnetic apparatus utilising such magnets. Such magnets can cause injury to a worker's fingers and hands during assembly of an apparatus when attempting to place such magnets on a ferromagnetic support member or backing plate.

In many situations flat plate type magnets are less costly than other magnetic separators to manufacture and would have a wider usage if such could be made to be more efficient for critical uses with more catch and retain capability as well as being easier to clean off the magnetic particles retained.

Recent improvements to magnets in this technical field, has largely been with grate type magnets. Flat and plate type magnets have remained almost the same for decades substituting only newer materials such as rare earth for older materials such as ferrites and alnico alloys.

The present invention seeks to overcome at least some of the abovementioned disadvantages by providing a apparatus for entrapping magnetic material.

SUMMARY OF THE INVENTION

In a first aspect the present invention consists of an apparatus for entrapping magnetic material, said apparatus comprising a first magnetic sub-assembly and a retention trap removably attached thereto, said retention trap having an entrapment surface such that magnetic material drawn into said trap as a result of the magnetic influence of said first magnetic sub-assembly is magnetically held and mechanically trapped within said entrapment surface, and wherein in use when said apparatus has been used to magnetically and mechanically trap magnetic material within said entrapment surface, said retention trap is removably detached from said first magnetic sub-assembly and at a remote location thereto a magnetic retriever is used to retrieve magnetic material from said entrapment surface of said retention trap.

Preferably said entrapment surface comprises an uneven surface including any one or combination of havens, deformations, depressions, pits, grooves, recesses, crevices, blind holes, pockets, bristles, protrusions, or troughs capable of mechanically entrapping said magnetic material.

Preferably said entrapment surface comprises an uneven surface and having a means of entrapment including any one or combination of textile fibres, magnetic and/or non-magnetic bar members, magnetic and/or non-magnetic rod members, bristles or posts.

Preferably said entrapment surface is any one or more of a profiled, embossed, dimpled, textured or knurled surface to provide a plurality of havens thereon.

Preferably said retention trap is formed as a single piece of non-magnetic material.

Preferably said retention trap is made of a combination of ferromagnetic and non-magnetic material.

Preferably said retention trap is flexible.

Preferably said retention trap is rigid.

Preferably said first magnetic sub-assembly comprises at least one magnetic cell mounted on a thin magnetic wafer plate.

Preferably said wafer plate is mounted to a magnetic back plate having thickness substantially greater than said wafer plate.

Preferably said at least one magnetic cell comprises a plurality of magnets.

Preferably said magnets are any one or more of Ferrite, Neodymium Iron Boron, rare earth, Samarium Cobalt or Alnico magnets.

Preferably said at least one magnetic cell is a plurality of magnetic cells, arranged as any one of twin sub-cells, twin strip sub-cells, quad sub-cells, quad strip sub-cells, sandwich sub-cells and sandwich strip sub-cells.

Preferably said at least one magnetic cell is in a protective cover.

Preferably said magnetic retriever has a magnetic bar whose magnetic influence is substantially the same or greater than the magnetic influence of said first magnetic sub-assembly.

Preferably in one embodiment said trap comprises a sticky mat having a strong adhesive bonding to remove foot contaminants.

Preferably said sticky mat is an elastomeric mat.

Preferably said sticky mat is dimpled.

Preferably said sticky mat has at least a portion which is impermeable.

Preferably said trap comprises an open cell foam containing anti-bacterial or sanitising liquid.

Preferably a bevelled ramp border surrounds said trap.

Preferably said ramp border is an integrally formed component made of material having elastomeric properties Preferably said at least one magnet disposed thereon is encased within a protective cover.

In a second aspect the present invention consists of a mat apparatus for entrapping magnetic material from the soles of shoes, said apparatus comprising a magnetic sub-assembly, a retention trap removably attached thereto, said retention trap having an entrapment surface such that magnetic material drawn into said trap as a result of the magnetic influence of said first magnetic sub-assembly is magnetically held and mechanically trapped within said entrapment surface, wherein said entrapment surface comprises an uneven surface capable of mechanically entrapping said magnetic material, and a removable bevelled ramp border surrounds said magnetic sub-assembly.

BRIEF DESCRIPTION OF THE DRAWINGS

A preferred embodiment of the invention will now be described, by way of example only, with reference to the accompanying drawings in which.

BEST MODE OF CARRYING OUT INVENTION

Figure 1:
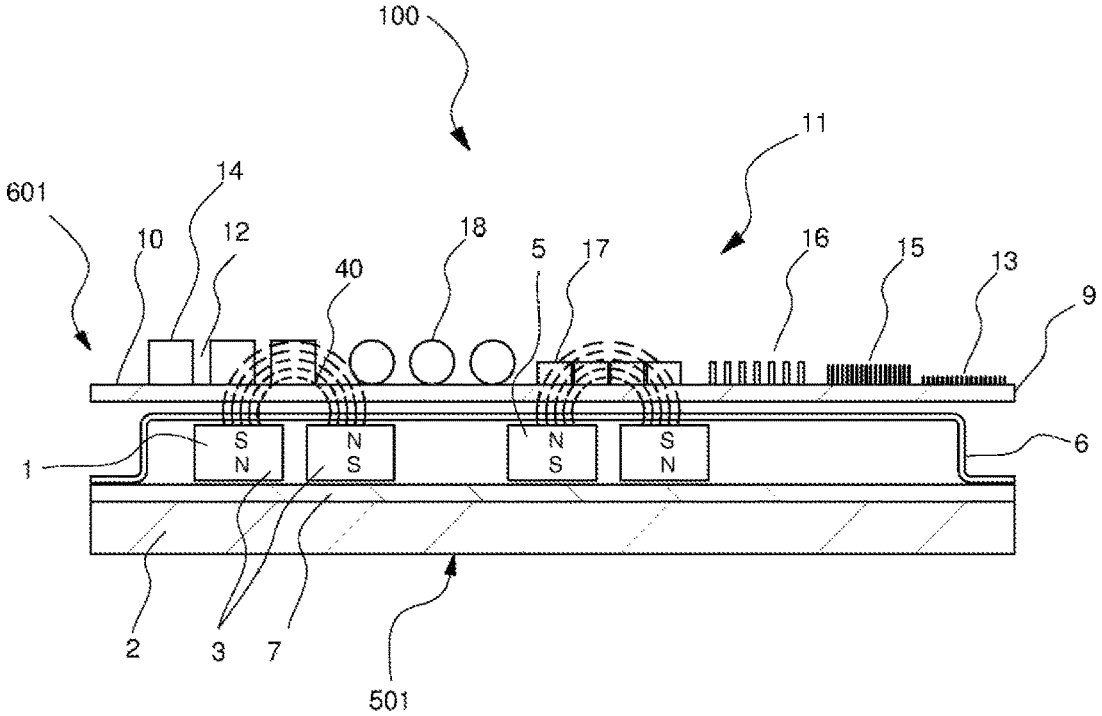
FIG. 1 is a schematic side elevation of a first embodiment of an apparatus for entrapping magnetic material.
Figure 2:
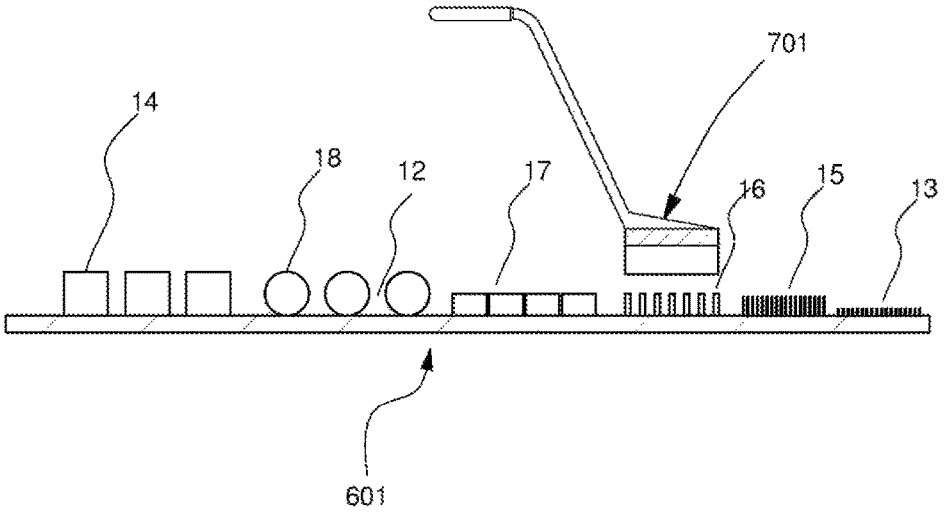
FIG. 2 depicts a retention trap of the apparatus of FIG. 1, with various example types of "entrapment means" depicted on its entrapment surface.
Figure 2A:
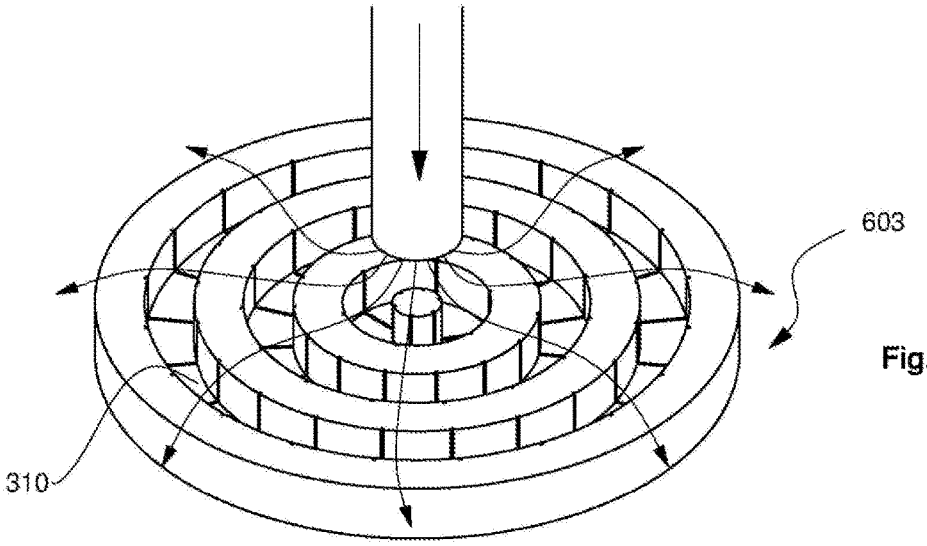
FIGS. 2*a* and 2*b* depict a perspective view and cross sectional view of a first alternative embodiment of retention trap for use with a magnetic sub-assembly.
Figure 2B:
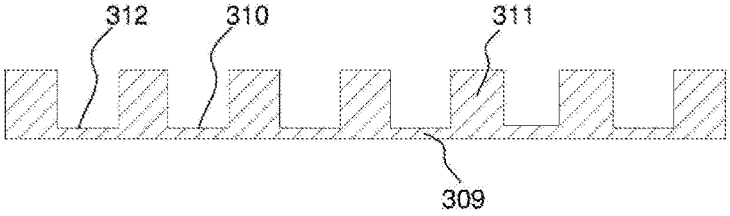
Figure 2C:
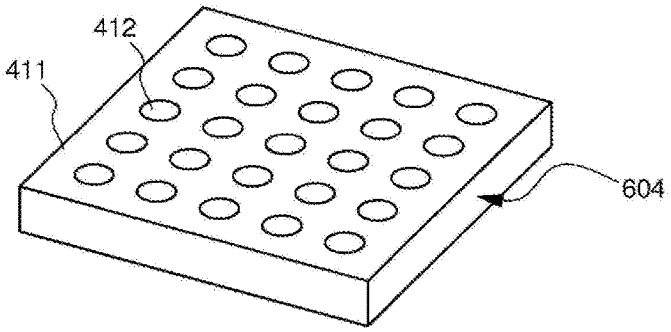
FIGS. 2*c* and 2*d* depicts a perspective view and cross sectional view of a second alternative embodiment of retention trap for use with a magnetic sub-assembly.
Figure 2D:
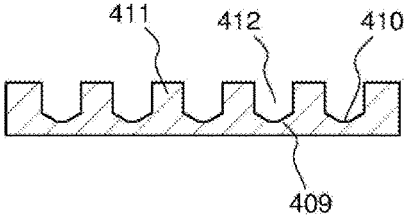

FIGS. 1 and 2 depict a first embodiment of an apparatus 100 for entrapping magnetic material. It comprises a ferromagnetic sub-assembly 501, comprising a plurality of magnets 1, back plate 2 and wafer plate 7.

Magnets 1 are preferably made of Ferrite, Neodymium Iron Boron, rare earth, Samarium Cobalt or Alnico magnets or combination of same which are arranged to form "magnetic cells" as best seen in FIG. 3.

Magnets 1 are disposed on back plate 2 as magnetic sub cells 3, which operate within a cell boundary 4, when arranged alongside and separate from other like sub cells 3. The arrangement of one or more sub cells 3 within cell boundaries 4 provides collectively, a sub cell working face 5 which may act through a non-magnetic protective cover 6.

Magnets 1 forming magnetic sub cells 3 are preferably pre-mounted on relatively thin "ferromagnetic" wafer plate 7.

Back plate 2 is preferably made of a relatively thick ferromagnetic plate, when compared to wafer plate 7.

Figure 3A:
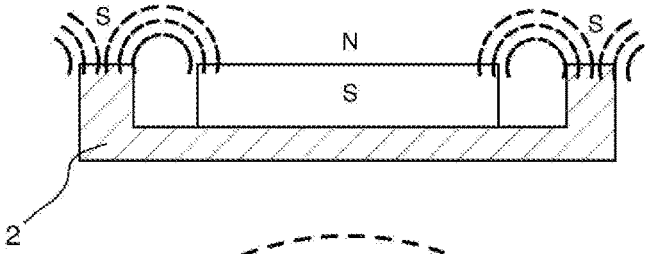
FIGS. 3*a* and 3*b* are schematic side and plan views of a magnet pot sub-cell arrangement used in a sub-assembly of the apparatus of FIG. 1.
Figure 3B:
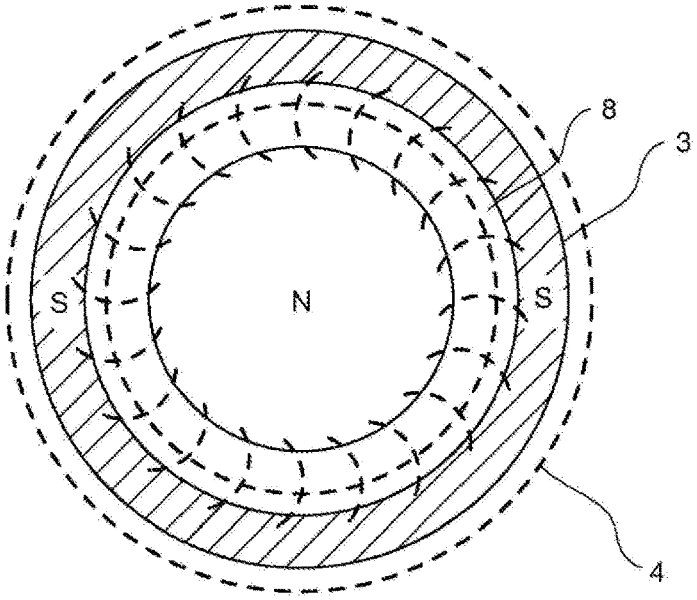
Figure 3C:
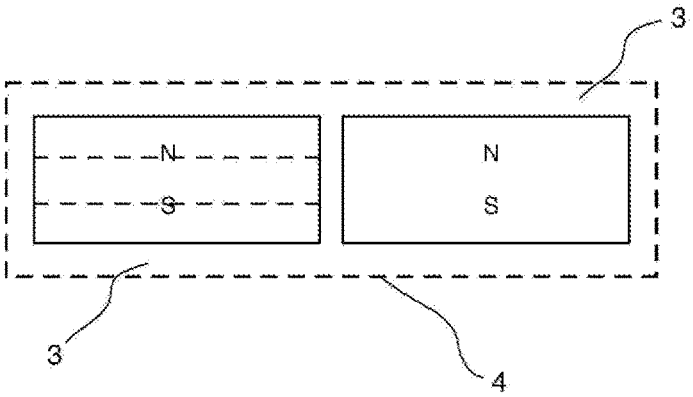
FIG. 3*c* is schematic side view of a magnet single sub-cell arrangement used in a sub-assembly of the apparatus of FIG. 1.
Figure 3D:
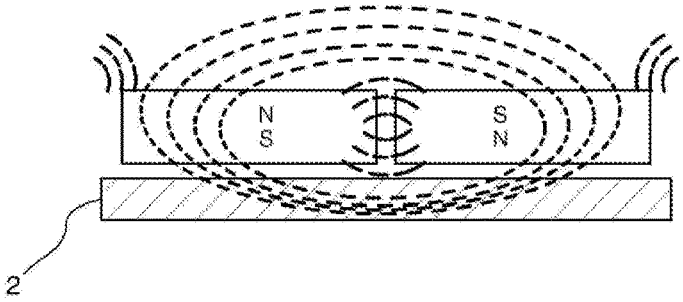
FIGS. 3*d* and 3*e* are schematic side and plan views of a magnet twin sub-cell arrangement used in a sub-assembly of the apparatus of FIG. 1.
Figure 3E:
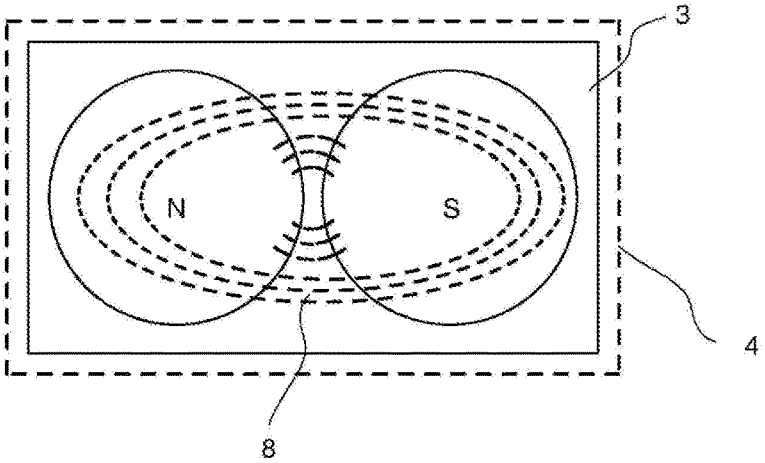
Figure 3F:
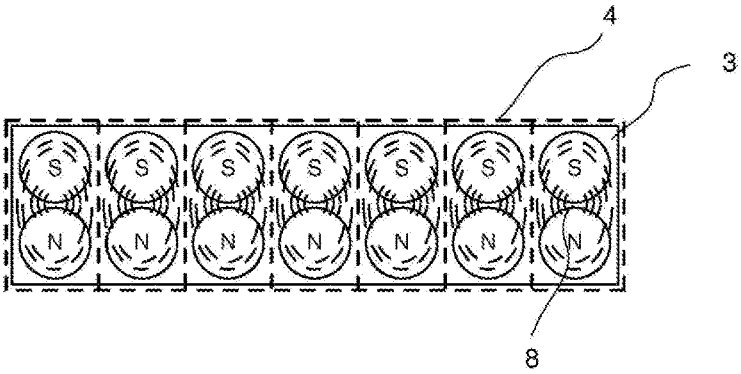
FIGS. 3*f* and 3*g* are schematic side and plan views of a magnet twin strip sub-cell arrangement used in a sub-assembly of the apparatus of FIG. 1.
Figure 3G:
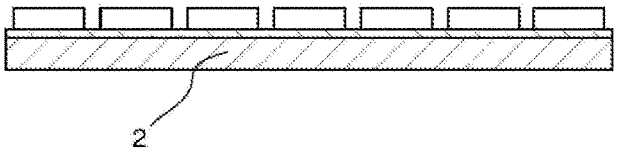
Figure 3H:
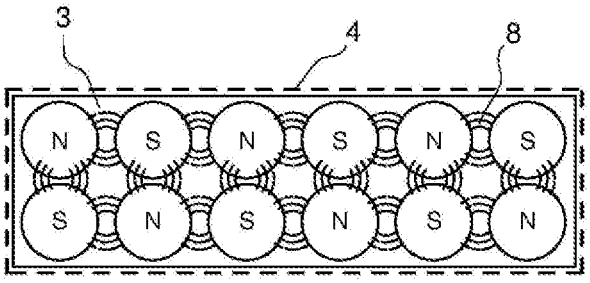
FIGS. 3*h* and 3*i* are schematic side and plan views of a magnet quad strip sub-cell arrangement used in a sub-assembly of the apparatus of FIG. 1.
Figure 3I:
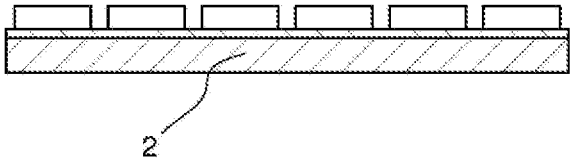
Figure 3J:
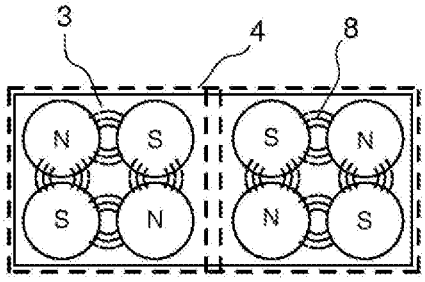
FIGS. 3*j* and 3*k* are schematic side and plan views of a magnet quad sub-cell arrangement used in a sub-assembly of the apparatus of FIG. 1.
Figure 3K:
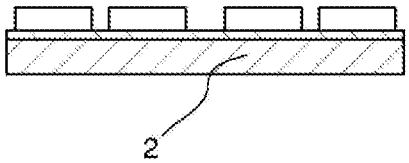

Various arrangements of magnet sub-cells 3 are shown in FIGS. 3*a*-3*k*, which can be used in sub-assembly 501 of apparatus 100. FIGS. 3*a* and 3*b* depict a "pot sub cell". FIG. 3*c* depicts a single sub cell. FIGS. 3*d* and 3*e* depict a twin sub cell. FIGS. 3*f* and 3*g* depict a twin strip sub cell. FIGS. 3*h* and 3*i* depict a quad strip sub cell, and FIGS. 3*j* and 3*k* depict a quad sub cell.

Magnet sub-cells 3 are first mounted on wafer back plate 7 of FIG. 1. Advantageously, when each or any of the magnetic sub-cells 3 is placed on back plate 2, substantially the total magnetic energy of magnets 1 making up sub-cell 3 is presented on working face 5. This preferred arrangement maximises the high flux density pole junction (gap) 8 on working face 5 between each magnet of unlike poles comprising the magnetic sub-cell 3.

Furthermore the arrangement of magnets 1 within each sub-cell 3 comprises a group of one or more magnets, wherein each magnet shares its high density pole junction 8 with no more than three other magnets of unlike poles. Examples of such cell configurations are disclosed in FIGS. 3, 6 and 7. This maximises the magnetic flux density at pole junctions 8 presented between each magnet comprising each sub-cell 3 within cell boundary 4 and providing the working face 5.

Whilst total energy of each sub-cell 3 and between each magnet 1 of each sub-cell 3 may be constant and so far maximised, a further increase in the flux density across the pole junction 8 between the individual magnets comprising said cells 3 is achieved by minimising the linear length of pole junctions 8 and as well as by minimising the "gap width" between unlike pole junctions 8 This is important to the ability of the invention to better capture weakly magnetic particles, hence the system selects discs or shaped pole junctions as preference.

Sub-cells 3 are provided to the area required in a pattern that ensures the energy of each sub-cell 3 within cell boundary 4, is not shared so as to deplete some of its closed cell energy to any other cell outside of each closed cell boundary 4. Preferred arrangements devised to achieve this effect are disclosed in FIGS. 3 to 7 and described as groups of: single sub-cells, twin sub-cells, twin strip sub-cells, quad sub-cells, quad strip sub-cells, sandwich sub-cells and sandwich strip sub-cells. All magnetic field actions disclosed thrust their magnetic force through any protective cover 6 of non magnetic material to provide the external working face 5, and may comprise an arrangement of any quantity of magnetic sub-cells 3 placed on base plate 2 via wafer plate 7, or directly to base plate 2.

Protective cover 6 shown in FIG. 1 may also serve to protect and seal the "patterned" magnet sub-cells 3 against ingress of oxygen and chemicals which quickly degrade rare earth magnet materials.

Individual magnets may be of any geometry such as squares, rectangles, discs, hexagons, diamond shapes or squares placed in a diamond pattern to optimise high density flux paths at pole junctions 8. A preferred pattern is that of "disc magnets" shown on FIG. 3

A removable mechanical retention trap 601, shown by itself in FIG. 2, is placed over ferromagnetic sub-assembly 501, as shown in FIG. 1, to form apparatus 100, which attracts, traps and retains fragments (not shown) of magnetic or weakly magnetic contamination.

Retention trap 601 has an entrapment surface 11, which is an "uneven surface" capable of mechanically trapping the fragments.

Entrapment surface 11 will be selected according to size of magnetic contamination to be trapped. As shown in FIG. 1, various types of "entrapment means" are possible including textile fibres 13, magnetic and non-magnetic members 14, bristles 15, matrix of posts (protrusions) 16, cellular honeycomb matrix 17 round bar matrix 18. The important feature of any of these "entrapment means" is that they provide an "uneven surface" so that some form of haven 12 exists.

Depending on the entrapment means chosen, the "uneven surface" may include any one or more of deformations, depressions, pits, grooves, recesses, crevices, blind holes, pockets, bristles, protrusions, or troughs capable of mechanically entrapping said magnetic material.

Entrapment surface 11 will now be described with reference to an embodiment including elements that range from the finest of non woven textile blanket style materials shown as fibres 13, which under microscope present myriads of havens 12 for minute magnetic contamination particles/fragments to be drawn into and held therein by virtue of the underlying areas of densified magnetic energy 40 at junctions 8. Such fibres 13 being flexible, occasional larger pieces of contamination are caused by the said magnetic energy 40 to depress the fibres so as to make their own impression providing resistance to opposing forces tending to move the particle/fragment off trap 601. Such flexible blanket like trap matrix comprising fibres 13 can be pre treated for water or soil repellence.

Figure 6:
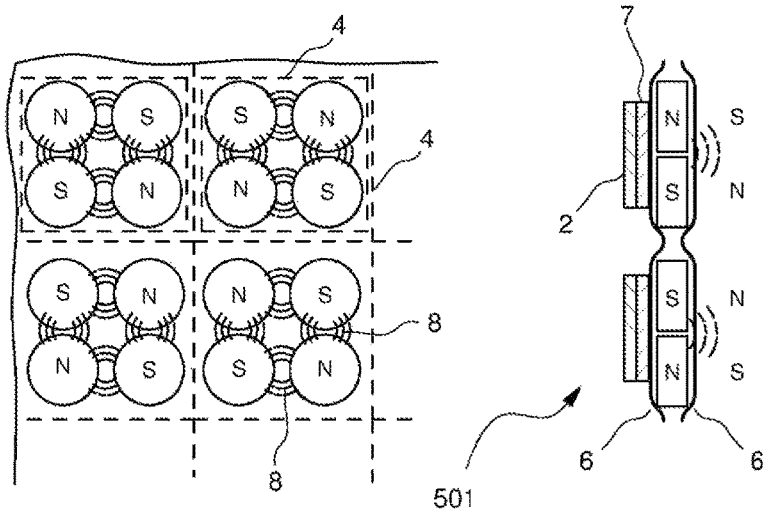
FIG. 6 and FIG. 7 depict sub-cell arrangements for use when the retention trap of FIG. 2 is to be flexible.
Figure 7:
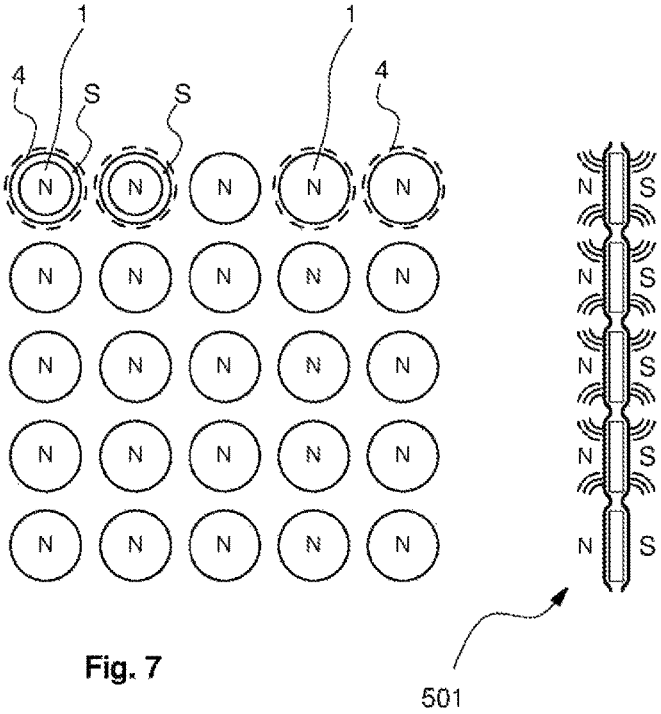
Figure 7A:
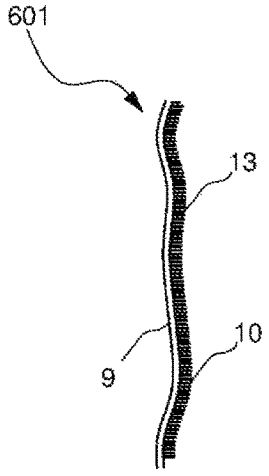
FIG. 7*a* is a side elevation view of a retention trap.

A further important embodiment of the invention enables both sub-assembly 501 and retention trap 601 to be flexible wherein selected sub-cells 3 or magnets 1 of sub-assembly 501, are attached or encased between two flexible protective covers 6 as shown in FIGS. 6 and 7.

FIG. 6 depicts a quad sub-cell of FIG. 3. Preferably on one of the outside surface of the protective covers 6 is placed wafer plate 7 and back plate. Preferably the magnets 1 are discs, so as to maximise flexibility and minimise tearing of protective covers 6, when in use. This assembly enables substantially all the energy of magnets 1 (and of quad sub-cells of FIG. 3) to be transferred to each working face 5 in high density flux bands across pole junctions 8. The sub cell boundaries 4 are all in repulsion to each other allowing flexibility without involuntary bunching.

A further embodiment is depicted in FIG. 7 wherein individual magnets 1 or pot sub-cells 3 of FIG. 3 are encased between covers 6 to provide a lower strength lighter flexible version of sub-assembly 501.

Both the FIG. 6 and FIG. 7 embodiments of sub-assembly 501 are used in conjunction with flexible blanket 13 versions of retention trap 601 depicted in FIG. 2. In these embodiments the trap base 9 is flexible.

When blanket retention trap 601 is removed from sub-assembly 501 it can be laid on a table and trapped magnetic fragments/particles may be retrieved using a retriever device, In FIG. 1 a schematic representation (not to scale) of retriever device 701 is shown. However, in FIG. 8, an embodiment of a magnetic retriever (or retriever device) 701 is shown and described further on.

Figure 4:
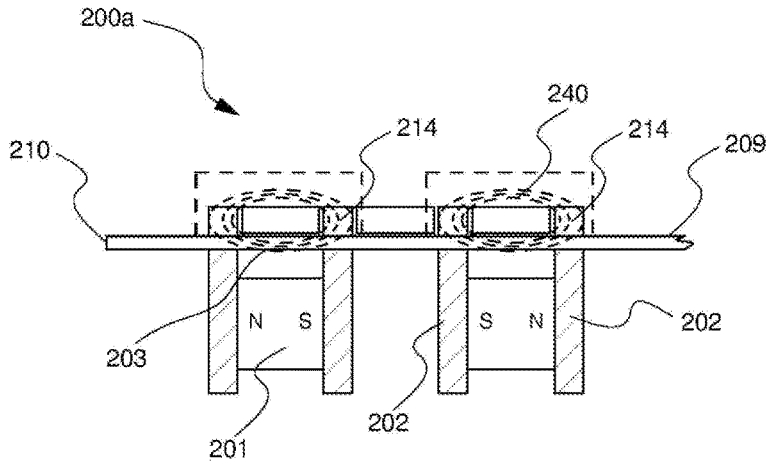
FIG. 4 depicts at cross section of a first alternative of second embodiment of an apparatus for entrapping magnetic material.
Figure 5:
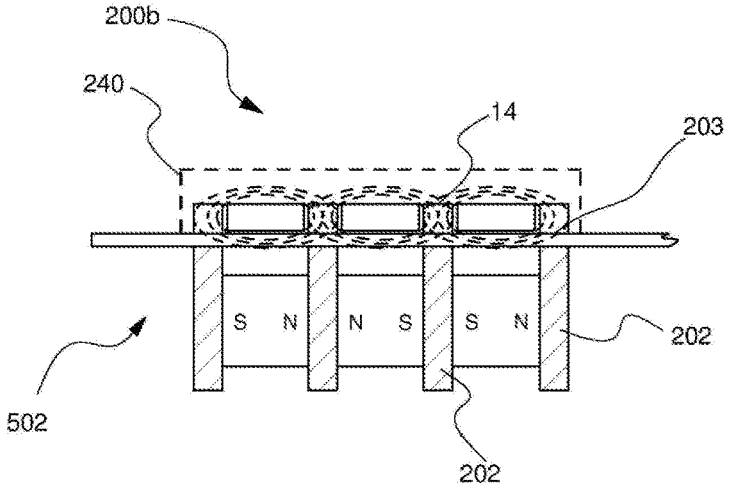
FIGS. 5 and 5*a* depict a cross section and upper perspective view of second alternative of second embodiment of an apparatus for entrapping magnetic material.
Figure 5A:
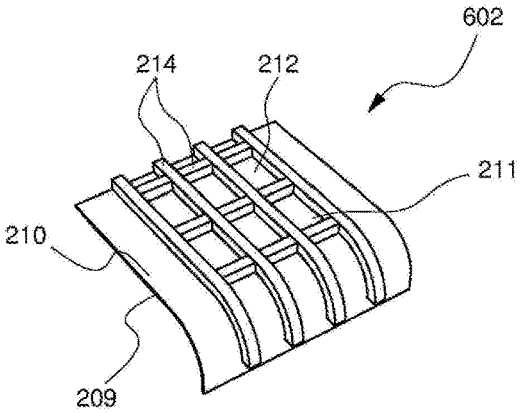

FIGS. 4, 5 and 5*a* depict alternatives of a second embodiment of an apparatus 200*a* and 200*b* for entrapping magnetic material. These embodiments are "heavy duty", and employ a retention trap 602 with a heavy duty entrapment surface 211. Sub-assembly 502 comprises back plate 202 with selected arrangements of magnetic cells 203 of selected magnitude in this arrangement (amount and type of magnetic material 201, are varied to trap and retain the largest pieces of tramp iron, such as that which causes damage to equipment in mining wood chip industries and bulk handling of raw materials and grain. In this case entrapment surface 211 utilises larger solid ferromagnetic or non ferromagnetic steel members 214 or a combination of both to form pits 212. Members 214 are welded or fixed to the non magnetic trap working surface 210 of the trap base 209, to form an impact plate embodiment. In use "tramp iron" is drawn into entrapment surface 211 under the influence of high flux density 240 of magnets 203, and held both magnetically and restrained mechanically within pits 212.

Advantageously in this embodiment, both the non magnetic trap base 209 and the ferromagnetic and/or non-magnetic members 214 attached thereto may be of impact and wear resistant materials. Also, in this embodiment the dimensions of the pits 212 will be selected according to the size of tramp iron and other magnetics to be retained.

Corresponding to any necessary variations to selected magnetic cells 3 or 203 shown in the abovementioned embodiments, entrapment surfaces 11 and 211 and their "entrapment means" can be varied depending on the size and of the magnetic material to be captured. In addition to the entrapment means" entrapment surfaces described for the abovementioned embodiments, other entrapment means for use as an entrapment surface may be selected from any one or more of woven wire ferromagnetic or non magnetic screen cloth, wedge wire, expanded metal, punched plate or any dimpled, embossed, profiled, textured or knurled surface which provide havens, troughs, depressions, crevices recesses etc to provide for mechanical restraint of fragments/particles/tramp iron.

FIGS. 2*a*,2*b* and 2*c*,2*d* depict alternative embodiments of retention traps 603 and 604 suitable for improved retention of magnetic materials in liquids and powders, which could be used with the sub-assemblies 501 and 502 of the earlier described embodiments. Retention traps 603 and 604 are preferably made from moulded plastic or elastomeric material.

Retention trap 603 is shown as a circular plate member. Its entrapment surface 311 has havens 312 being "concentric circular grooves' with working surface 310 and a base 309.

Retention trap 604 is shown as a square plate member. Its entrapment surface 411 has havens 412 being formed blind holes with working surface 410 and a base 409.

Retention traps 603 and 604 are representative of the varied type of "single-piece" retention traps that can be made by non-magnetic material, such as plastic or rubber. In other not shown embodiments, "single-piece" retention traps could have any one or more profiled, embossed, dimpled, textured or knurled entrapment surfaces to provide the necessary havens, it should also be understood that retention traps 603 and 604, as well as the other not shown embodiments formed in one piece may have additional properties such as food grade, low friction, anti stick, as well as impact, and/or wear resistant properties, including but not limited to materials such as Ultra high molecular weight Polyethylene and Polyurethane, FRAS rubbers or fused cast nylons.

Retention traps 603 and 604 when used with say a sub-assembly 501 of the first embodiment, are specially effective in applications where liquid products are pumped or allowed to fall on entrapment surfaces 311,411 wherein the magnetic contamination is attracted to the base surfaces 310,410 of the profiled havens 312,412 where the magnetic flux is the most dense by virtue of base surfaces 310,410 being nearest to magnetic sub-assembly 501. Advantageously the magnetic contamination displaces non magnetic product which passes on as substantially metal contamination free.

Retention trap 604 in combination with say a sub-assembly 501 is particularly effective when used as the base or on the floor of a vibratory feeder or conveyor (not shown). Preferably retention trap 604 is removable from the conveyor. Preferably a sub assembly is attached to the underside of the feeder or is independently mounted with a small clearance between the conveyor tray and the magnetic sub plate. Preferably the conveyor is a thin folded non magnetic stainless steel tray as is often used in the food, pharmaceutical and chemical industries for handling powders and products of <20 mm size. In this embodiment the "magnetics" entrained with the product are drawn into havens 412 where they are retained preferentially on and close to the base 409 where the magnetic flux of sub-assembly 501 is most dense, particularly at areas corresponding to pole junctions 8. Advantageously, the vibratory feeding action moves the non magnetic product on as substantially metal fragment free.

It is to be noted that in all of the abovementioned embodiments, the retention traps 601, 602, 603 and 604 are detachable from the magnetic assembly of FIG. 1 so as to enable extraction of the collected magnetics from the havens 12, 212, 312 and 412 after the retention traps are removed and are remote from the magnetic influence of magnetic sub plate assemblies 501 and 502.

It should be understood that magnets 1 whilst shown as "disc magnets in FIG. 3 of the first embodiment, could in alternative embodiments be squares with or without rounded edges, or placed in a diamond pattern where the "areas of highest magnetic flux density" are presented in intensified bands on working face 5 of retention trap 601, and then act through a non magnetic trap base 9 forming the trap working surface 10, and into entrapment surface 11.

Figure 8:
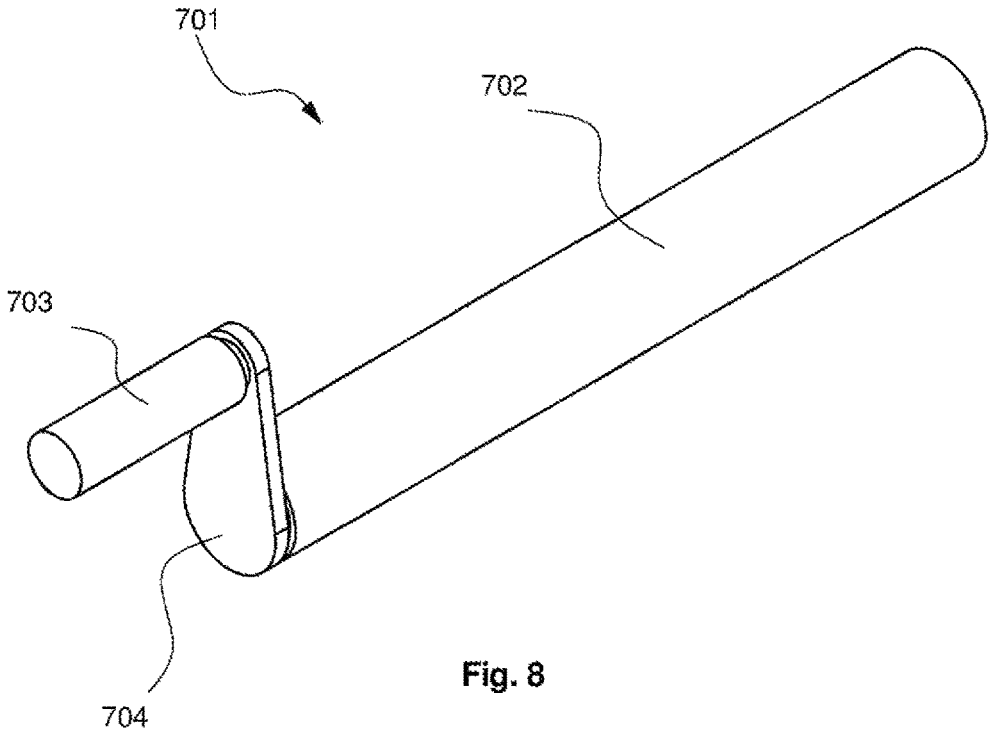
FIG. 8 depicts a perspective view of an embodiment of a magnetic retriever for use with apparatus for entrapping magnetic material.

FIG. 8 depicts a magnetic retriever 701, which has a "multi pole" magnetic bar 702, handle 703 and interconnecting member 704. Magnetic bar 702 must have a magnetic influence (flux density) which is at least the same or greater than that of sub-assemblies 501, 502. Magnetic bar 702 can in its simplest embodiment as shown, be fixed. Alternatively, magnetic bar 702 can be a "roller" by use of a roller bearing (not shown) where it interconnects with member 704. Also in another embodiment the magnetic retriever may have a magnetic bar which is a roller and supported at both ends by interconnecting members which are attached to a handle.

Magnetic retriever 701 is capable of extracting fragments from the earlier described retention traps 601, 602, 603 and 604 when they are removed and are remote from the magnetic influence of magnetic sub plate assemblies 501 and 502.

FIGS. 9*a*-9*e* (depict five alternative embodiments of retention traps for use with apparatus for entrapping magnetic material, as described earlier. The magnet base 512 depicted in these alternatives may be the ferromagnetic sub-assemblies 501,502 of the earlier embodiments.

Figure 9A:
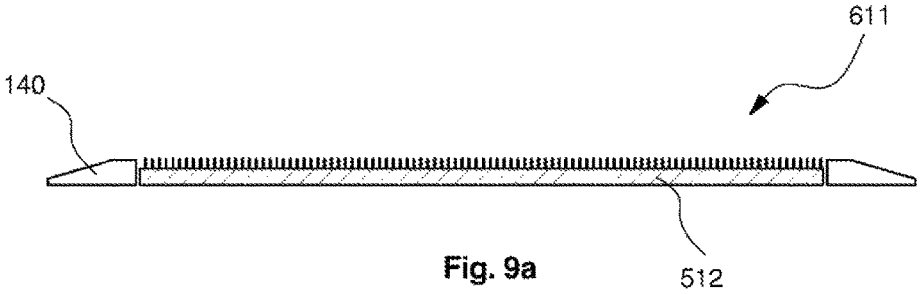
FIGS. 9*a*-9*e* depict various alternative embodiments of retention traps suitable for use with the apparatus for entrapping magnetic material depicted in FIG. 1.

FIG. 9*a* depicts a bristle, fabric or other trap 611 surrounded by a bevelled ramp border 40. Trap 61 overlays magnet base 512.

Figure 9B:
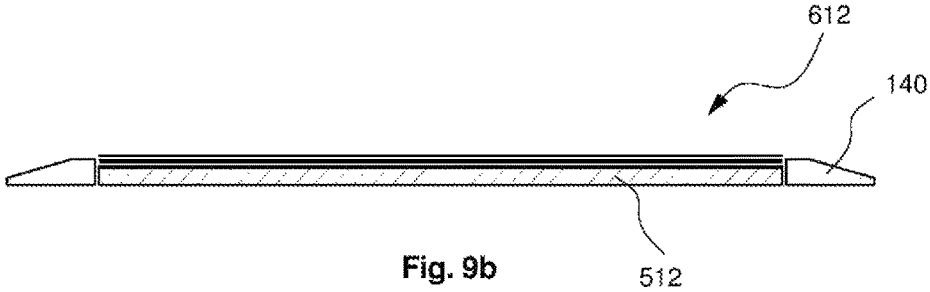

FIG. 9*b* depicts a magnet base 512 in which trap 612 is a "disposable sticky mat" which overlays the magnetic face. Trap 612 could be made of conventional sticky sheet material, such as that marketed under the trade mark Tacky Mat®, which utilises a strong adhesive bonding to remove foot contaminants. Magnet base 612 exerts a force on the metallic fragments/magnetic particles and pulls them down on the sticky/tacky surface enhancing effectiveness (particularly when the sticky mats become less tacky), and making them last longer. In use the constant pull force of magnet base 612 will enable the fragments to form their own indentation complimenting the ability of the sticky surface to hold such particles, particularly when the sticky mat becomes dulled and nearing its time for replacement. It should also be understood that the "disposable sticky mat" could be "dimpled" to further enhance mechanical retention of particles.

Figure 9C:
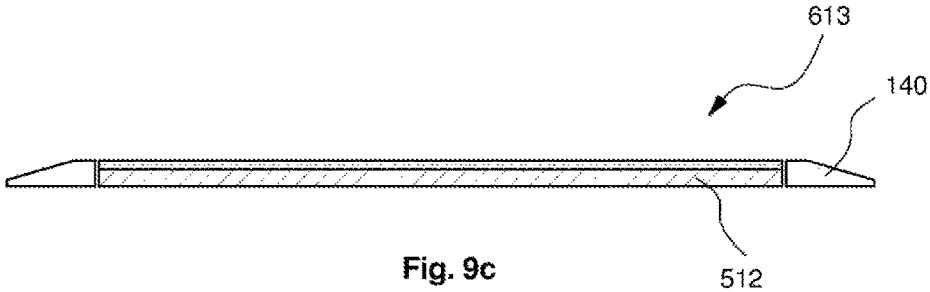

FIG. 9*c* depicts a magnet base 612 in which trap 613 is a "elastomeric sticky mat" which overlays the magnetic face. Magnet base 612 exerts a force on the metallic fragments/magnetic particles and pulls them down into the elastomer so they become swallowed or embedded and trapped by virtue of the magnetic force. Like that of the abovementioned embodiment of FIG. 12*b*, as adhesion of the "elastomeric sticky mat" trap 613 lessens in effectiveness due to dust, etc, the magnetic force of base 512 keeps the sticky mat trap 613 effective on magnetic particles.

Figure 9D:
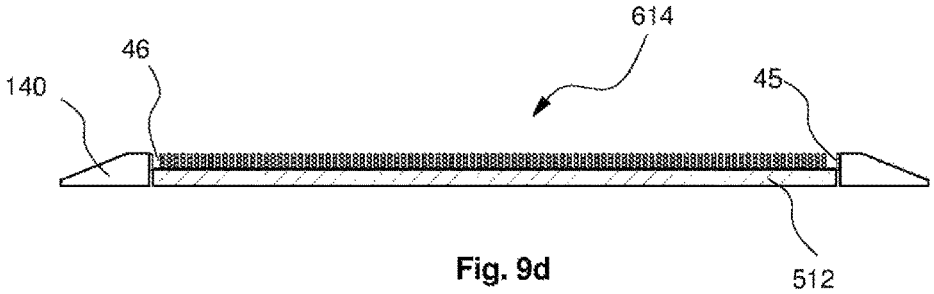

FIG. 9*d* depicts a magnet base 612 in which trap 614 is an "open cell foam" trap contained in a receptacle (tray) 45 disposed above magnet base 512. Trap 614 contains antibacterial or sanitising liquid. The liquid level is shown as 46. This liquid absorbs into trap 614 and is used to sanitise the base and contact areas of work boots and shoes being walked over the magnetically influenced surface before walking into more sensitive hygiene areas. In this case magnet base 512 increases the effectiveness of the sanitising system by also effectively trapping metal and magnetic fragments in the "open cell foam" trap 614.

Figure 9E:
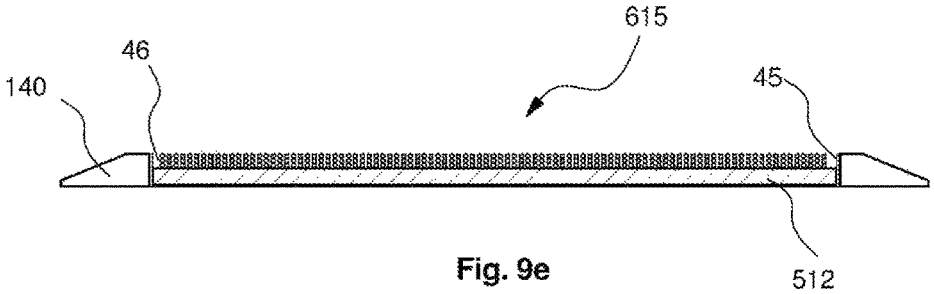

FIG. 9*e* depicts a magnet base 512 in which trap 615 is an "open cell foam" trap is overlayed magnet base 512. Trap 615 is similar to trap 614, however in this arrangement both trap 615 and magnet base 512 are in receptacle 45 which contains the liquid.

In the embodiments shown in FIGS. 9*a*, 9*d* and 9*e*, retention traps 611, 614 and 615 each preferably include a liquid impermeable base or layer) bonded to the underside thereof. This impermeable base (or layer) may be integral with the trap or applied thereto as a separate layer.

All of the embodiments shown FIGS. 9*b*-9*e* have a bevelled ramp border 140 similar to that shown in FIG. 9*a*. Ramp border 140 acts as a safety ramp, and is included in these embodiments to enable trolley wheels to ride up onto and be treated by the trap surfaces and as a safety measure to prevent a trip edge. The surface of ramp border 140 is approximately level or higher than the selected "trap" surface, and may serve to retain the trap 612 in its operating position on magnet base 512. Ramp border 140 is preferably made of a rubber (or rubber-like) material or some other material having elastomeric properties. Preferably ramp border 140 is made a single integrally formed component.

Figure 10:
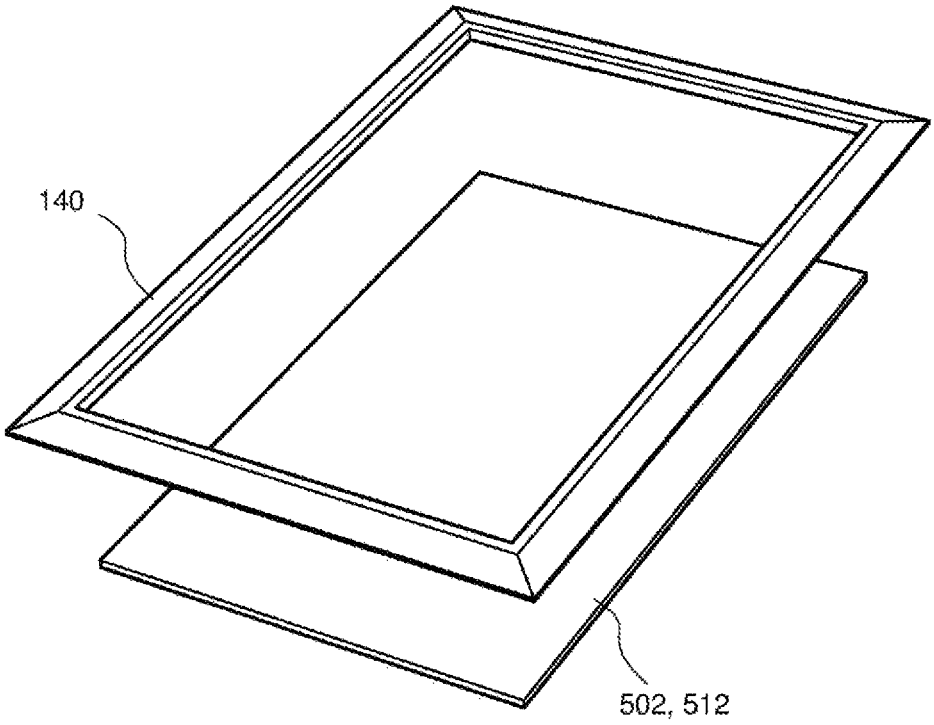
FIG. 10 depicts an exploded view of a magnet sub-assembly (base) and ramp border.

FIG. 10 depicts an exploded view of ramp border 140 and magnet base 501,512 when the apparatus of the present invention is used as floor mat. In use magnet base 501,512 would first be placed on the floor, and then ramp border 140 would be placed there around. Once ramp border is in place, a retention trap (eg 601, 612) for example, could then be placed over magnet base 501,512.

The present invention in its various embodiments has application in various industries as follows.

Manufacturing industry—Improved separation of magnetic particles from coolants used in machinery and grinding operations including stainless steel. In this application the coolant could be discharged onto the centre of a "retention trap" of the "apparatus for entrapping magnetic material", so the magnetic particles are trapped in the matrix until cleaned off. The retention trap can be cleaned manually by removing it from the magnetic influence of the magnetic sub plate or automatically by having the retention trap in the form of a conveyor passing over the magnetic sub plate and being cleaned off by vacuum, spraying or magnetically or other means when out of range of the sub-assembly magnetic influence.

The invention also provides new possibilities in extraction of fine iron particles from ball milled chemicals and powders such as cement, carbon black, mineral powders and ingredients for glass making etc.

Petroleum industry: May benefit from means alternative to conventional magnetic bars or rods to extract fine wear iron from drilling mud. In this application the mud could be pumped onto the retention trap placed in a ferromagnetic chute wherein the chute bottom forms at least part of the sub-assembly of the present invention. Wear iron or magnetic particles entrained in the mud would be captured and retained in the retention trap. Under the influence of the sub-assembly the magnetic particles displace the nonmagnetic particles from the retention trap havens/cavities. The mud supply could then be diverted to another similar chute while the retention trap is then sprayed with water to remove non-magnetics. When the retention trap is lifted away from sub-assembly "magnetic influence", it can then be cleaned using the magnetic retriever and the magnetic residue weighed for determination of boring tool wear.

Mining and other industries: Including but not limited to: Woodchip mills, sugar mills, quarries, portable crushing and screening plants, brickworks, above ground coal handling, steel making and bulk materials handling In these heavier industries suspension magnets and plate magnets are frequently used for extraction of tramp iron and magnetic contamination to protect against machinery damage or improve the iron free quality of incoming or outgoing raw materials. The most effective position for such magnets in theory is over the trajectory of discharging conveyed materials. Although frequently suggested this is rarely adopted due to heavy weight of conventional suspension magnets, wear on the magnet surface, catch and lose effect due to product e.g. rocks dislodging and sweeping collected iron back into the product and difficulty in cleaning of permanent magnets.

The present invention can be applied in these circumstances on a larger scale where the improved higher density cell arrangements of sub-assembly of the present invention, enable lower weight high surface strength magnets to be used requiring less costly supporting structure. The fields then similarly act through a wear resistant retention trap matching the fields of the sub-assembly. As disclosed this at least two-part extraction system of the present invention in combination, improves retention of magnetics and enables replacement of the retention trap on the working face which takes more punishment of wear and impact and enables easier cleaning off of collected magnetics, as the sub-assembly and retention trap are separated, where necessary, with appropriate mechanical assistance in the heavier applications of the invention.

Compressed or blown air systems: where instead of fine filtering through large area filters or grates of magnetic bars, the air stream containing magnetic particles is blown normal to or at an angle towards a retention trap. The magnetic force behind the retention trap, supplied by a sub-assembly, enables the particles to be retained and baffled whereas on a smooth plate surface they would be swept off by the air stream even though the plate is highly magnetic. When the retention trap is removed from the magnetic influence the trapped particles can be retrieved using the magnetic retriever or otherwise by conventional best means. The invention offers an alternative to grates of bar magnets normally considered too expensive for large areas.

Food industry—more effective prevention of transfer of weakly magnetic fragments such as work hardened Stainless Steel Swarf, linishing, polishing and grinding residues etc. which are generated in any construction or maintenance work area or food processing plant workshop. Such fragments can fall into food sensitive process equipment or become attached to soles of shoes and work boots and become a hazard to food safety when walked through sensitive processing areas.

The improved "apparatus for entrapping magnetic material" as disclosed will be more capable of defragmentising soles of work boots than prior art methods including conventional magnetic mats, magnetic boot brushes and non-magnetic sticky mats. The sub-assembly of the first part, with its separate retention trap of the second part, can be arranged to be walked over including when immersed in sanitizing foot baths as is the custom in the food processing and pharmaceutical industries thus enabling both de-fragmentising and sanitizing functions to be accomplished simultaneously.

Other applications in the food, milling and dairy industry are made possible by the invention for example a means to provide more efficient extraction of fine black weakly magnetic specs found in flour, semolina, dairy powders and liquid foods. In this case both the retention trap and sub-assembly would be varied to be food grade and constructed of hygienic food contact approved materials such as white natural rubber, SS matrix, Ultra high molecular weight polyethylene (UHMWPE) or a preferably white food grade retention surface material.

Many uses for the present invention are anticipated where existing magnet installations are less effective than required or possible for reducing risk of product contamination, brand name damage, product recall or machinery damage and downtime costs.

The terms "comprising" and "including" (and their grammatical variations) as used herein are used in inclusive sense and not in the exclusive sense of "consisting only of.

The invention claimed is:

1. A mat assembly to remove magnetic material from shoes of a wearer passing over and engaging the mat assembly, the mat assembly comprising:

an assembly base providing, a base plate having an upper surface, at least one magnetic cell fixed with respect to the base plate so as to be above the upper surface, and a protective cover made of non-magnetic material and positioned above the cell to at least aid in protecting the cell; and a mat portion of rectangular configuration so as to provide a pair of spaced longitudinal side edges and a pair of spaced transverse edges, the mat portion providing, a non-magnetic trap base to be positioned above the assembly base and removably resting on the assembly base, the trap base having a working surface to be engaged by the shoes and in which the magnetic material can become embedded, with the cell attracting magnetic material from the shoes so that the magnetic material becomes embedded in the working surface.

2. A mat assembly as claimed in claim 1, wherein the working surface comprises an uneven surface including any one or combination of havens, deformations, depressions, pits, grooves, recesses, crevices, blind holes, pockets, bristles, protrusions, or troughs.

3. A mat assembly as claimed in claim 1, wherein the working surface comprises any one or combination of textile fibres, bar members, rod members, bristles or posts.

4. A mat assembly as claimed in claim 1, wherein the working surface is any one or more of a profiled, embossed, dimpled, textured or knurled surface to provide a plurality of havens thereon.

5. A mat assembly as claimed in claim 1, wherein the working surface is formed as a single piece of non-magnetic material.

6. A mat assembly as claimed in claim 1, wherein the at least one magnetic cell comprises a plurality of magnets.

7. A mat assembly as claimed in claim 6, wherein the magnets are any one or more of Ferrite, Neodymium Iron Boron, rare earth, Samarium Cobalt or Alnico magnets.

8. A mat assembly as claimed in claim 6, wherein the at least one magnetic cell is a plurality of magnetic cells, arranged as any one of twin sub-cells, twin strip sub-cells, quad sub-cells, quad strip sub-cells, sandwich sub-cells and sandwich strip sub-cells.

9. A mat assembly as claimed in claim 1, wherein the mat portion comprises a sticky mat having a strong adhesive bonding to remove foot contaminants.

10. A mat assembly as claimed in claim 9, wherein the sticky mat is an elastomeric mat.

11. A mat assembly as claimed in claim 9, wherein the sticky mat is dimpled.

12. A mat assembly as claimed in claim 9, wherein the sticky mat has at least a portion which is impermeable.

13. A mat assembly as claimed in claim 1, wherein the mat portion comprises an open cell foam containing anti-bacterial or sanitising liquid.

* * * * *